US008410430B2

(12) United States Patent
Kenny et al.

(10) Patent No.: US 8,410,430 B2
(45) Date of Patent: Apr. 2, 2013

(54) MASS SPECTROMETER

(75) Inventors: Daniel James Kenny, Cheshire (GB); Jason Lee Wildgoose, Stockport (GB)

(73) Assignee: Micromass UK Limited, Manchester (GB)

( * ) Notice: Subject to any disclaimer, the term of this patent is extended or adjusted under 35 U.S.C. 154(b) by 530 days.

(21) Appl. No.: 12/522,769

(22) PCT Filed: Jan. 15, 2008

(86) PCT No.: PCT/GB2008/000121

§ 371 (c)(1), (2), (4) Date: Oct. 16, 2009

(87) PCT Pub. No.: WO2008/087389

PCT Pub. Date: Jul. 24, 2008

(65) Prior Publication Data

US 2010/0096543 A1 Apr. 22, 2010

Related U.S. Application Data

(60) Provisional application No. 60/887,260, filed on Jan. 30, 2007.

(30) Foreign Application Priority Data

Jan. 15, 2007 (GB) ..... 0700735.4

(51) Int. Cl.
*H01J 49/00* (2006.01)

(52) U.S. Cl. ..... 250/287; 250/281; 250/282; 250/283; 250/285; 250/288; 250/290; 250/292; 250/294

(58) Field of Classification Search ..... 250/281–283, 250/285, 287, 288, 290, 292, 294
See application file for complete search history.

(56) References Cited

U.S. PATENT DOCUMENTS

| | | | | |
|---|---|---|---|---|
| 5,396,065 | A | 3/1995 | Myerholtz et al. | |
| 6,300,626 | B1 | 10/2001 | Brock et al. | |
| 2001/0030284 | A1* | 10/2001 | Dresch et al. | 250/287 |
| 2004/0183007 | A1* | 9/2004 | Belov et al. | 250/287 |
| 2004/0238755 | A1* | 12/2004 | Lee et al. | 250/423 R |
| 2004/0245452 | A1* | 12/2004 | Bateman et al. | 250/287 |
| 2005/0133712 | A1* | 6/2005 | Belov et al. | 250/287 |

FOREIGN PATENT DOCUMENTS

| | | |
|---|---|---|
| GB | 2396957 | 7/2004 |
| JP | 2000048765 | 2/2000 |
| JP | 2005183022 | 7/2005 |
| JP | 2006023390 | 1/2006 |
| WO | 2008/087389 | 7/2008 |

OTHER PUBLICATIONS

Pringle, Steven D., et al; An investigation of the mobility separation of some peptide and protein ions using a new hybrid quadruopole/travelling wave IMS/oa-TOF instrument; International Journal of Mass Spectrometry, 261 (2007) 1-12.

* cited by examiner

*Primary Examiner* — Nikita Wells
*Assistant Examiner* — Meenakshi Sahu
(74) *Attorney, Agent, or Firm* — Diederiks & Whitelaw, PLC

(57) ABSTRACT

A Time of Flight mass analyser is disclosed wherein the time period between successive orthogonal acceleration pulses is less than the time of flight of ions having the maximum mass to charge ratio of interest. As a result, some ions are subject to wrap-around and will appear in a subsequent mass spectrum. Mass spectra obtained at two different sampling rates may be compared and mass peaks relating to ions which have and have not been subject to wrap-around may be identified.

15 Claims, 7 Drawing Sheets

MASS SPECTROMETER

CROSS REFERENCE TO RELATED APPLICATIONS

This application is the National Stage of International Application No. PCT/GB2008/000121, filed Jan. 15, 2008, which claims priority to and benefit of United Kingdom Patent Application No. 0700735.4, filed Jan. 15, 2007 and U.S. Provisional Patent Application Ser. No. 60/887,260, filed Jan. 20, 2007. The entire contents of these applications are incorporated herein by reference.

The present invention relates to a mass spectrometer and a method of mass spectrometry.

Conventional orthogonal acceleration Time of Flight mass analysers are arranged to transmit ions having approximately all the same energy through an orthogonal acceleration region. An orthogonal acceleration electric field is then periodically applied across the orthogonal acceleration region. The length of the orthogonal acceleration region, the energy of the ions and the frequency of application of the orthogonal acceleration electric field determine the sampling duty cycle for sampling ions for analysis in the Time of Flight mass analyser. Ions having approximately the same energy but different mass to charge ratios will have different velocities and hence will have different sampling duty cycles.

In a conventional orthogonal acceleration Time of Flight mass analyser the frequency of application of the orthogonal acceleration electric field is arranged so as to prevent time of flight spectral wrap-around which is viewed as being deleterious. The time period between successive applications of the orthogonal acceleration electric field is therefore arranged to be greater than the time of flight of ions having the maximum mass to charge ratio within the packet of ions which was orthogonally accelerated into the drift or time of flight region of the Time of Flight mass analyser. If this condition is not met then time of flight spectral wrap-around will result wherein ions having relatively high mass to charge ratios will be recorded at artificially low flight times in a subsequent mass spectrum. This effect will then lead to incorrect mass to charge ratio assignments and hence is to be avoided.

The maximum ion sampling duty cycle of a conventional orthogonal acceleration Time of Flight mass spectrometer operated in a conventional mode of operation wherein a continuous ion beam is sampled periodically is typically approximately 20-25%. The maximum sample duty cycle is achieved for ions having the maximum mass to charge ratio of interest and the ion sampling duty cycle will be less for ions having relatively low mass to charge ratios. If ions having the maximum mass to charge ratio have a mass to charge ratio value of mo and the sampling duty cycle for these ions is DCo, then the sampling duty cycle DC for ions having a mass to charge ratio equal to m is given by:

$$DC = DCo\sqrt{\frac{m}{mo}} \tag{1}$$

It can be shown that the average sampling duty cycle DCav is equal to two-thirds of the maximum sampling duty cycle DCo. Therefore, if the maximum sampling duty cycle is 22.5% then the average sampling duty cycle is 15%.

It is desired to provide an improved mass spectrometer and method of mass spectrometry.

According to an aspect of the present invention there is provided a method of mass spectrometry comprising: providing a Time of Flight mass analyser comprising an orthogonal acceleration electrode and a drift or time of flight region; and repeatedly energising the orthogonal acceleration electrode so as to repeatedly orthogonally accelerate packets of ions into the drift or time of flight region.

The periodicity of energising the orthogonal acceleration electrode or the time period between successive energisations of the orthogonal acceleration electrode is preferably less than the time of flight of ions having the maximum mass to charge ratio within the packets which are orthogonally accelerated into the drift or time of flight region.

According to an embodiment the periodicity of energising the orthogonal acceleration electrode or the time period between successive energisations of the orthogonal acceleration electrode is preferably less than the time of flight of ions having the maximum mass to charge ratio of interest which are orthogonally accelerated into the drift or time of flight region.

The periodicity of energising the orthogonal acceleration electrode or the time period between successive energisations of the orthogonal acceleration electrode is preferably at least x % less than the time of flight of ions having the maximum mass to charge ratio within the packets of ions which are orthogonally accelerated into the drift or time of flight region. Preferably, x is selected from the group consisting of: (i) <1; (ii) 1-5; (iii) 5-10; (iv) 10-15; (v) 15-20; (vi) 20-25; (vii) 25-30; (viii) 30-35; (ix) 35-40; (x) 40-45; (xi) 45-50; (xii) 50-60; (xiii) 60-70; (xiv) 70-80; (xv) 80-90; and (xvi) 90-100.

According to the preferred embodiment the method preferably further comprises:

orthogonally accelerating packets of ions into the drift or time of flight region with a first periodicity or wherein a first time period $\Delta t1$ is maintained between successive energisations of the orthogonal acceleration electrode; and obtaining first time of flight or mass spectral data.

According to the preferred embodiment the method preferably further comprises:

orthogonally accelerating packets of ions into the drift or time of flight region with a second periodicity or wherein a second different time period $\Delta t2$ is maintained between successive energisations of the orthogonal acceleration electrode; and obtaining second time of flight or mass spectral data.

The difference between the first periodicity and the second periodicity or the difference between the first time period $\Delta t1$ and the second time period $\Delta t2$ is preferably selected from the group consisting of: (i) <0.1 μs; (ii) 0.1-0.5 μs; (iii) 0.5-1 μs; (iv) 1-2 μs; (v) 2-3 μs; (vi) 3-4 μs; (vii) 4-5 μs; (viii) 5-6 μs; (ix) 6-7 μs; (x) 7-8 μs; (xi) 8-9 μs; (xii) 9-10 μs; (xiii) 10-15 μs; (xiv) 15-20 μs; (xv) 20-25 μs; (xvi) 25-30 μs; (xvii) 30-35 μs; (xviii) 35-40 μs; (xix) 40-45 μs; (xx) 45-50 μs; and (xxi) >50 μs.

The method preferably further comprises combining the first time of flight or mass spectral data and the second time of flight or mass spectral data to produce a first combined data set D1. The method preferably further comprising obtaining modified second time of flight or mass spectral data by shifting, translating, adjusting or correcting the second time of flight or mass spectral data by a time period or a mass to charge ratio value which is substantially equal to or which corresponds to the difference between the first time period $\Delta t1$ and the second time period $\Delta t2$. The method preferably further comprises combining the first time of flight or mass spectral data and the second modified time of flight or mass spectral data to produce a second combined data set D2. The method preferably further comprises comparing the first combined data set D1 and the second combined data set D2.

According to an embodiment the method further comprises comparing the first time of flight or mass spectral data with the second time of flight or mass spectral data. The method preferably further comprises determining whether or not one or more peaks in the first time of flight or mass spectral data correspond with one or more peaks in the second time of flight or mass spectral data having substantially the same time of flight, mass or mass to charge ratio and/or substantially the same intensity. The method preferably further comprises identifying as non-wrapped data, time of flight or mass spectral peaks which have substantially the same time of flight, mass or mass to charge ratio and/or substantially the same intensity in the first time of flight or mass spectral data as in the second time of flight or mass spectral data.

According to the preferred embodiment the step of comparing the first combined data set D1 and the second combined data set D2 comprises:

determining the ratio of the intensity I1 of a time of flight peak or mass spectral peak at a first time or mass to charge ratio in the first combined data set D1 to the intensity I2 of a time of flight peak or mass spectral peak at substantially the same first time or mass to charge ratio in the second combined data set D2; and determining whether or not the ratio equals or exceeds a value y1.

According to the preferred embodiment the step of comparing the first combined data set D1 and the second combined data set D2 comprises:

determining the ratio of the intensity I2 of a time of flight peak or mass spectral peak at a first time or mass to charge ratio in the second combined data set D2 to the intensity I1 of a time of flight peak or mass spectral peak at substantially the same first time or mass to charge ratio in the first combined data set D1; and determining whether or not the ratio equals or exceeds a value y1.

The value y1 is preferably selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.1; (xxii) 2.1-2.2; (xxiii) 2.2-2.3; (xxiv) 2.3-2.4; (xxv) 2.4-2.5; (xxvi) 2.5-2.6; (xxvii) 2.6-2.7; (xxviii) 2.7-2.8; (xxix) 2.8-2.9; (xxx) 2.9-3.0; (xxxi) 3.0-3.1; (xxxii) 3.1-3.2; (xxiv) 3.2-3.3; (xxiv) 3.3-3.4; (xxv) 3.4-3.5; (xxvi) 3.5-3.6; (xxvii) 3.6-3.7; (xxviii) 3.7-3.8; (xxix) 3.8-3.9; (xxx) 3.9-4.0; and (xxxi) >4.0.

According to another embodiment the method preferably further comprises converting the first combined data set D1 into a first peak list P1 of the time of flight or mass to charge ratio and associated intensity of each peak in the first combined data set D1. The method preferably further comprises converting the second combined data set D2 into a second peak list P2 of the time of flight or mass to charge ratio and associated intensity of each peak in the second combined data set D2.

The method preferably further comprises comparing the first peak list P1 with the second peak list P2. The method preferably further comprises determining whether or not one or more peaks in the first peak list P1 correspond with one or more peaks in the second peak list P2 having substantially the same time of flight, mass or mass to charge ratio and/or substantially the same intensity. The method preferably further comprises identifying as non-wrapped data, time of flight or mass spectral peaks which have substantially the same time of flight, mass or mass to charge ratio and/or substantially the same intensity in the first peak list P1 as in the second peak list P2.

The method preferably further comprises determining the ratio of the intensity of a peak in the first peak list P1 having a first time of flight or mass to charge ratio to the intensity of a peak in the second peak list P2 having substantially the same first time of flight or mass to charge ratio;

and determining whether the ratio equals or exceeds a value y2.

The method further comprises determining the ratio of the intensity of a peak in the second peak list P2 having a first time of flight or mass to charge ratio to the intensity of a peak in the first peak list P1 having substantially the same first time of flight or mass to charge ratio; and determining whether the ratio equals or exceeds a value y2.

The value y2 is preferably selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.1; (xxii) 2.1-2.2; (xxiii) 2.2-2.3; (xxiv) 2.3-2.4; (xxv) 2.4-2.5; (xxvi) 2.5-2.6; (xxvii) 2.6-2.7; (xxviii) 2.7-2.8; (xxix) 2.8-2.9; (xxx) 2.9-3.0; (xxxi) 3.0-3.1; (xxxii) 3.1-3.2; (xxiv) 3.2-3.3; (xxiv) 3.3-3.4; (xxv) 3.4-3.5; (xxvi) 3.5-3.6; (xxvii) 3.6-3.7; (xxviii) 3.7-3.8; (xxix) 3.8-3.9; (xxx) 3.9-4.0; and (xxxi) >4.0.

According to a less preferred embodiment the method preferably further comprises: orthogonally accelerating one or more first packets of ions into the drift or time of flight region and operating the Time of Flight mass analyser in a first mode of operation wherein ions having a first mass to charge ratio are arranged to have a first time of flight from being orthogonally accelerated to impinging upon or reaching an ion detector or other device. The method preferably further comprises: orthogonally accelerating one or more second packets of ions into the drift or time of flight region and operating the Time of Flight mass analyser in a second mode of operation wherein ions having the first mass to charge ratio are arranged to have a second different time of flight from being orthogonally accelerated to impinging upon or reaching an ion detector or other device.

In the first mode of operation an electric field strength which affects the first time of flight is preferably set at a first value and in the second mode of operation an electric field strength which affects the second time of flight is preferably set at a second different value. Preferably, relative to the first value the second value differs by an amount selected from the group consisting of: (i) <1%; (ii) 1-5%; (iii) 5-10%; (iv) 10-15%; (v) 15-20%; (vi) 20-25%; (vii) 25-30%; (viii) 30-35%; (ix) 35-40%; (x) 40-45%; (xi) 45-50%; (xii) 50-60%; (xiii) 60-70%; (xiv) 70-80%; (xv) 80-90%; (xvi) 90-100%; (xvii) 100-110%; (xix) 110-120%; (xx) 120-130%; (xxi) 130-140%; (xxii) 140-150%; (xxiii) 150-160%; (xxiv) 160-170%; (xxv) 170-180%; (xxvi) 180-190%; (xxvii) 190-200%; (xxviii) 200-250%; (xxix) 250-300%; (xxx) 300-350%; (xxxi) 350-400%; (xxxii) 400-450%; (xxxiii) 450-500%; and (xxxiv) >500%.

According to an embodiment the method may further comprise determining whether or not peaks in the first time of flight or mass spectral data and/or the second time of flight or mass spectral data have a peak width less than or greater than a predetermined or relative amount.

According to an embodiment the method may further comprise:

mass filtering ions so that ions having mass to charge ratios within a first range are substantially attenuated or are not onwardly transmitted; and determining whether or not peaks in the first time of flight or mass spectral data and/or the second time of flight or mass spectral data have a time of flight, mass or mass to charge ratio which would be expected of ions having mass to charge ratios falling within the first range.

The method according to the preferred embodiment preferably comprises identifying time of flight or mass spectral peaks which relate to wrapped-around data wherein time of flight or mass spectral peaks are observed in a time of flight or mass spectrum which relates to an orthogonal acceleration event but wherein the ions which are represented by the time of flight or mass spectral peaks were orthogonally accelerated in or by a prior orthogonal acceleration event. The method preferably further comprises correcting time of flight or mass spectral peak data which relates to or which includes wrapped-around data.

The method according to the preferred embodiment preferably further comprises identifying time of flight or mass spectral peaks which relate to non wrapped-around data wherein time of flight or mass spectral peaks are observed in a time of flight or mass spectrum which relates to an orthogonal acceleration event and wherein the ions which are represented by the time of flight or mass spectral peaks were not orthogonally accelerated in or by a prior orthogonal acceleration event.

According to an aspect of the present invention there is provided a Time of Flight mass analyser comprising an orthogonal acceleration electrode and a drift or time of flight region; and control means arranged and adapted to repeatedly energise the orthogonal acceleration electrode so as to repeatedly orthogonally accelerate packets of ions into the drift or time of flight region, wherein the periodicity of energising the orthogonal acceleration electrode or the time period between successive energisations of the orthogonal acceleration electrode is less than the time of flight of ions having the maximum mass to charge ratio within the packets of ions which are orthogonally accelerated into the drift or time of flight region.

According to an aspect of the present invention there is provided a mass spectrometer comprising a Time of Flight mass analyser as described above.

The mass spectrometer preferably comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) a Thermospray ion source; (xviii) a Particle Beam ("PB") ion source; and (xix) a Flow Fast Atom Bombardment ("Flow FAB") ion source.

The mass spectrometer preferably further comprises a mass filter or mass analyser arranged upstream and/or downstream of the Time of Flight mass analyser. The mass filter or mass analyser is preferably selected from the group consisting of: (i) a quadrupole rod set mass filter; (ii) a Time of Flight mass filter or mass analyser; (iii) a Wein filter; and (iv) a magnetic sector mass filter or mass analyser.

The mass spectrometer preferably further comprises a collision, fragmentation or reaction device selected from the group consisting of: (i) a Collision Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xviii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions.

According to an aspect of the present invention there is provided a Time of Flight mass analyser comprising an orthogonal acceleration electrode, a drift or time of flight region and an ion detector, wherein in a mode of operation the time period between successive energisations of the orthogonal acceleration electrode is $t_1$ and the flight time of ions having a maximum mass to charge ratio that may be (or which are to be) detected by the ion detector is $t_2$, and wherein $t_1<t_2$.

According to an aspect of the present invention there is provided a method of mass analysing ions comprising:

providing an orthogonal acceleration electrode, a drift or time of flight region and an ion detector; and setting the time period between successive energisations of the orthogonal acceleration electrode as $t_1$ wherein the flight time of ions having a maximum mass to charge ratio that may be (or which are to be) detected by the ion detector is $t_2$, and wherein $t_1<t_2$.

According to an aspect of the present invention there is provided a Time of Flight mass analyser wherein the time period between successive applications of an orthogonal acceleration electric field is less than the time of flight of ions having a maximum mass to charge ratio of interest or the time of flight of ions having a maximum mass to charge ratio which are orthogonally accelerated by the orthogonal acceleration electric field.

According to an aspect of the present invention there is provided a method of mass analysing ions comprising:

setting the time period between successive applications of an orthogonal acceleration electric field to be less than the time of flight of ions having a maximum mass to charge ratio of interest or the time of flight of ions having a maximum mass to charge ratio which are orthogonally accelerated by the orthogonal acceleration electric field.

According to an aspect of the present invention there is provided a method of mass spectrometry comprising:

orthogonally accelerating a first packet of ions and obtaining a first data set;

orthogonally accelerating a second subsequent packet of ions and obtaining a second data set; and analysing the second data set to identify data which relates to ions from the first packet of ions.

According to an aspect of the present invention there is provided a mass spectrometer comprising:

a device arranged and adapted to orthogonally accelerate a first packet of ions and to obtain a first data set;

a device arranged and adapted to orthogonally accelerate a second packet of ions and to obtain a second data set; and a device arranged and adapted to analyse the second data set to identify data which relates to ions from the first packet of ions.

According to an aspect of the present invention there is provided a method of identifying time of flight and/or mass spectral peaks that have undergone wrap-around in time of flight or mass spectral data.

According to an aspect of the present invention there is provided a mass spectrometer arranged and adapted to identify time of flight and/or mass spectral peaks that have undergone wrap-around in time of flight or mass spectral data.

According to an aspect of the present invention there is provided a method of correcting the time of flight and/or mass to charge ratio of time of flight and/or mass spectral peaks that have undergone wrap-around in time of flight or mass spectral data.

According to an aspect of the present invention there is provided a mass spectrometer arranged and adapted to correct the time of flight and/or mass to charge ratio of time of flight and/or mass spectral peaks that have undergone wrap-around in time of flight or mass spectral data.

According to the preferred embodiment there is provided an orthogonal acceleration Time of Flight mass spectrometer or mass analyser wherein the period between the repetitive application of the orthogonal acceleration electric field is substantially less than the time of flight of ions having the maximum mass to charge ratio value which are present within the packet of ions which was orthogonally accelerated into the time of flight or drift region of the Time of Flight mass analyser. The preferred embodiment also relates to a method of identifying those mass spectral peaks that relate to ions that have undergone wrap-around i.e. mass spectral peaks which appear in a mass spectrum but which actually relate to ions that were orthogonally accelerated by a previous orthogonal acceleration event. The preferred embodiment also relates to a method of calculating the correct times of flight and/or mass to charge ratios of ions which have undergone wrap-around.

In a preferred embodiment the time period between the application of the orthogonal acceleration electric field may be switched between two or more known values. The two or more time periods are preferably both substantially less than the time of flight of the ions having the maximum mass to charge ratio of interest which are orthogonally accelerated into the drift or time of flight region of the Time of Flight mass analyser. The electric field(s) that preferably affect the time of flight of ions is preferably kept constant. The change in time period preferably causes the arrival time of ions that have undergone wrap-around to shift whereas peaks relating to ions that have not undergone wrap-around do not shift. This approach enables peaks relating to ions that have undergone wrap-around to be recognised according to the preferred embodiment.

According to a less preferred embodiment one or more electric fields that affect the time of flight of ions may be switched between two or more set values whilst the time period between successive applications of an orthogonal acceleration field is kept preferably substantially constant. The time period between successive applications of the orthogonal acceleration field is preferably substantially less than the time of flight of ions having a maximum mass to charge ratio of interest which are orthogonally accelerated into the drift or time of flight region of the Time of Flight mass analyser. The change in electric field preferably causes the arrival time of peaks relating to wrapped-around ions to shift differently to peaks that relate to ions that have not wrapped-around. This effect is preferably used to recognise peaks relating to wrapped-around ions and/or peaks relating to non wrapped-around ions.

According to another less preferred embodiment both the electric field(s) that affects the time of flight of ions and the time period between successive applications of the orthogonal acceleration electric field may be switched or varied between two or more set values thereby combining the mechanisms used in the two embodiments referred to above.

According to an embodiment a characteristic of a peak that is different between peaks that relate to ions that have been wrapped-around and peaks that relate to ions that have not been wrapped-around, such as the peak widths, may be used to recognise peaks relating to wrapped-around ions and/or peaks relating to non wrapped-around ions. For example, peaks relating to wrapped-around ions may have a greater width than peaks that relate to ions that have not been wrapped-around but which have substantially similar arrival times.

According to an embodiment the mass to charge ratios of ions entering the orthogonal acceleration region may have mass to charge ratios above a known minimum value i.e. the mass to charge ratio range of ions which are to be analysed by the Time of Flight mass analyser may be restricted by incorporating a low mass to charge ratio cut-off upstream of the Time of Flight mass analyser. According to this embodiment the Time of Flight mass analyser may be arranged such that ions having relatively high mass to charge ratios arrive in a time frame in which ions having relatively low mass to charge ratios (i.e. below the cut-off value) from a subsequent pulse would have arrived if they had been orthogonally accelerated. The time period between the application of the orthogonal acceleration electric field may be set so that ions with the highest mass to charge ratio from a preceding pulse arrive at times such that they can not overlap or coincide with the arrival time of ions having relatively low mass to charge ratios from the subsequent pulse.

According to the preferred embodiment the duty cycle of ions across a wide range of mass to charge ratios may be increased compared to the duty cycle obtained by operating a conventional Time of Flight mass analyser in a conventional mode of operation wherein a continuous ion beam is sampled periodically.

An ion source is preferably provided which preferably comprises a pulsed ion source such as a Laser Desorption Ionisation ("LDI") ion source, a Matrix Assisted Laser Desorption Ionisation ("MALDI") ion source or a Desorption Ionisation on Silicon ("DIOS") ion source.

Alternatively, the mass spectrometer may comprise a continuous ion source such as an Electrospray Ionisation ("ESI") ion source, an Atmospheric Pressure Chemical Ionisation ("APCI") ion source, an Electron Impact ("EI") ion source, an Atmospheric Pressure Photon Ionisation ("APPI") ion source, a Chemical Ionisation ("CI") ion source, a Fast Atom Bombardment ("FAB") ion source, a Liquid Secondary Ion Mass Spectrometry ("LSIMS") ion source, a Field Ionisation ("FI") ion source or a Field Desorption ("FD") ion source. Other continuous or pseudo-continuous ion sources may also be used.

The mass spectrometer may include a mass filter which is preferably arranged downstream of the ion source and upstream of the orthogonal acceleration Time of Flight mass analyser. The mass filter may be used in a mode of operation to transmit ions having a single mass to charge ratio or a range of mass to charge ratios. The mass filter may, for example, comprise a multi-pole rod set, a quadrupole mass filter, a Time of Flight mass spectrometer, a Wein filter or a magnetic sector mass analyser.

The mass spectrometer may comprise a collision, reaction or fragmentation cell which is preferably arranged upstream of the orthogonal acceleration Time of Flight mass analyser. In one mode of operation at least some ions entering the collision, reaction or fragmentation cell may be caused to collide, react or fragment into daughter, fragment, product or adduct ions.

Various embodiments of the present invention together with an arrangement given for illustrative purposes only will now be described, by way of example only, and with reference to the accompanying drawings in which.

Figure 1A:
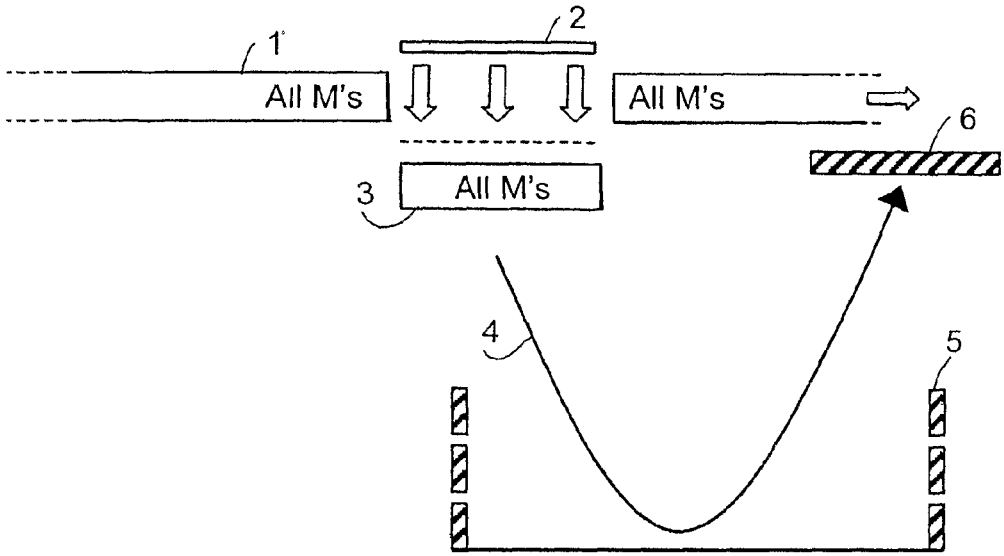
FIG. 1A PRIOR ART
FIG. 1A shows a conventional orthogonal acceleration Time of Flight mass analyser and FIG. 1B shows a plot of the duty cycle versus mass to charge ratio for the conventional orthogonal acceleration Time of Flight mass analyser operated in a conventional mode of operation wherein a continuous ion beam is sampled periodically.

A conventional orthogonal acceleration Time of Flight (oa-TOF) mass analyser operating in a conventional mode of operation is arranged to sample a continuous beams of ions by periodically accelerating ions out of an orthogonal acceleration region into a drift or time of flight region of the mass analyser. FIG. 1A illustrates the basic operation of a conventional orthogonal acceleration Time of Flight mass analyser. A continuous beam of ions 1 is arranged to pass through an orthogonal acceleration region which is arranged adjacent an orthogonal acceleration or pusher electrode 2. A fraction 3 of the continuous beam of ions 1 is orthogonally accelerated into a drift or time of flight region by applying a voltage to the orthogonal acceleration or pusher electrode 2. Ions which are orthogonally accelerated into the drift or time of flight region follow a trajectory as generally indicated by arrow 4 and are reflected by a reflectron 5 towards an ion detector 6.

In a conventional mode of operation the orthogonal acceleration voltage is not applied to the orthogonal acceleration or pusher electrode 2 until the last ions from a previous pulse have reached the ion detector 6. The last ions to arrive at the ion detector 6 from a pulse are those ions which have the highest mass to charge ratio. The conventional mode of operating the conventional Time of Flight mass analyser prevents ions having relatively high mass to charge ratios from a preceding pulse from being recorded as ions having a relatively low mass to charge ratio in a mass spectrum which relates to a subsequent pulse.

Figure 1B:
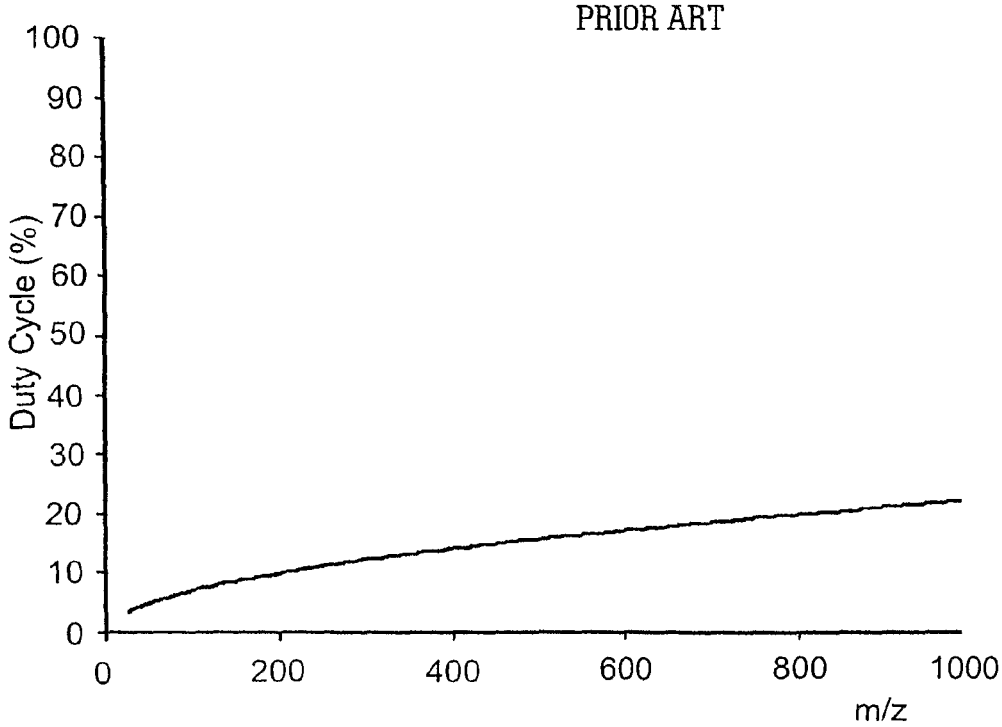
FIG. 1B PRIOR ART

The maximum sampling duty cycle DC for ions having a mass to charge ratio m/z is determined by the geometry of the system and is typically between 10% and 25%. The maximum sampling duty cycle may be calculated using the following relation:

$$DC(m/z) = \frac{W}{L}\sqrt{\frac{m/z}{(m/z)_{max}}} \tag{2}$$

wherein w is the length of the orthogonal acceleration or pusher region, L is the separation between the centre of the orthogonal acceleration or pusher electrode and the centre of the ion detector and $(m/z)_{max}$ is the maximum mass to charge ratio of ions of interest. The duty cycle is therefore lowest for ions having relatively low mass to charge ratios and is highest for ions having relatively high mass to charge ratios. FIG. 1B shows a specific example of the duty cycle as a function of mass to charge ratio for the case wherein w/L=0.22.

Figure 2A:
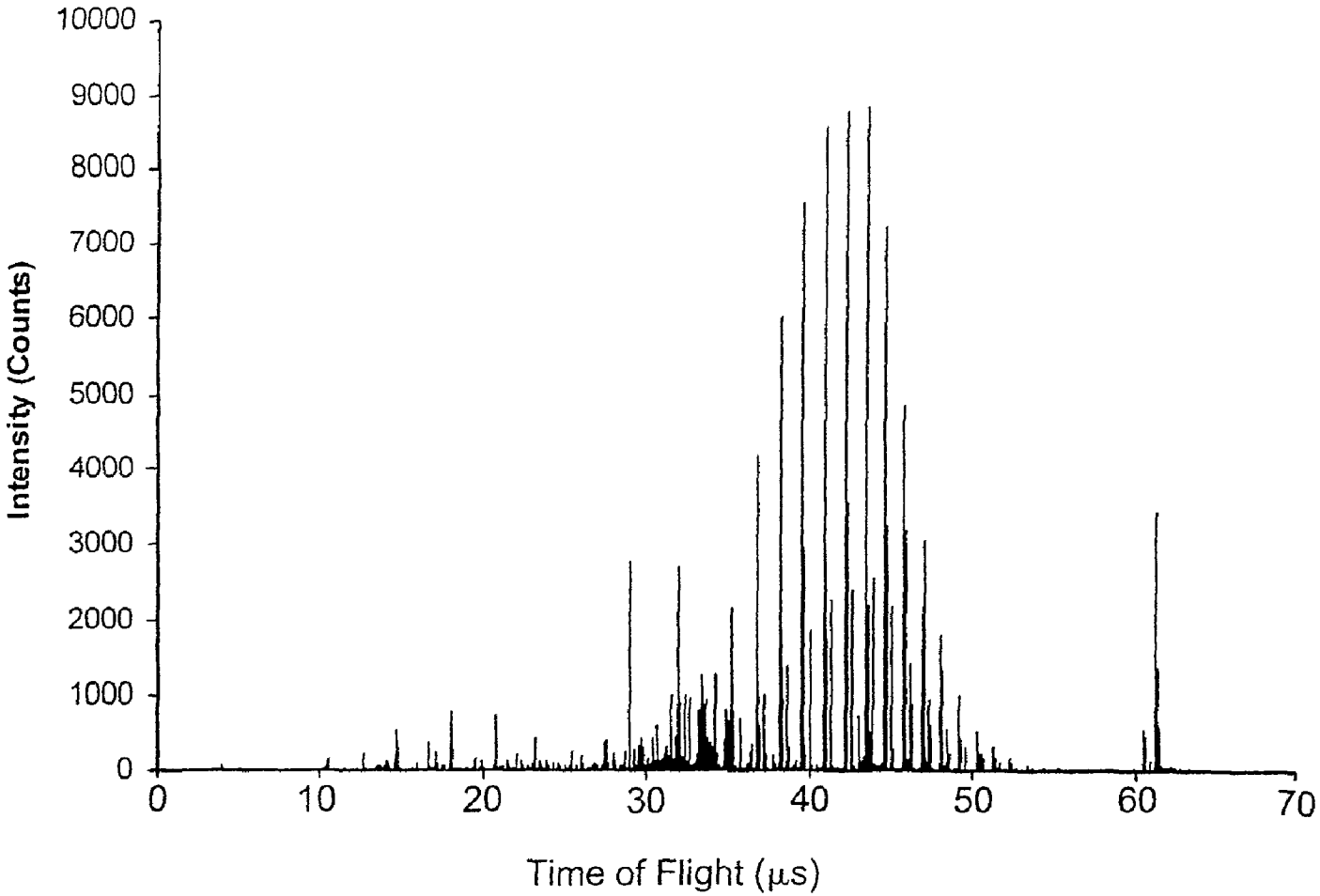
FIG. 2A PRIOR ART
FIG. 2A shows a conventional time of flight spectrum and FIG. 2B shows a mass spectrum which corresponds to the time of flight spectrum shown in FIG. 2A.

FIG. 2A shows a conventional time of flight spectrum wherein the period between successive applications of the orthogonal acceleration electric field is longer than the time of flight of ions having the highest mass to charge ratio which were orthogonally accelerated into the drift or time of flight region of the Time of Flight mass analyser. The time period between successive applications of the orthogonal acceleration electric field for the data shown in FIG. 2A was set to 66 μs and the time of flight for ions having the maximum mass to charge ratio was approximately 61.2 μs.

Figure 2B:
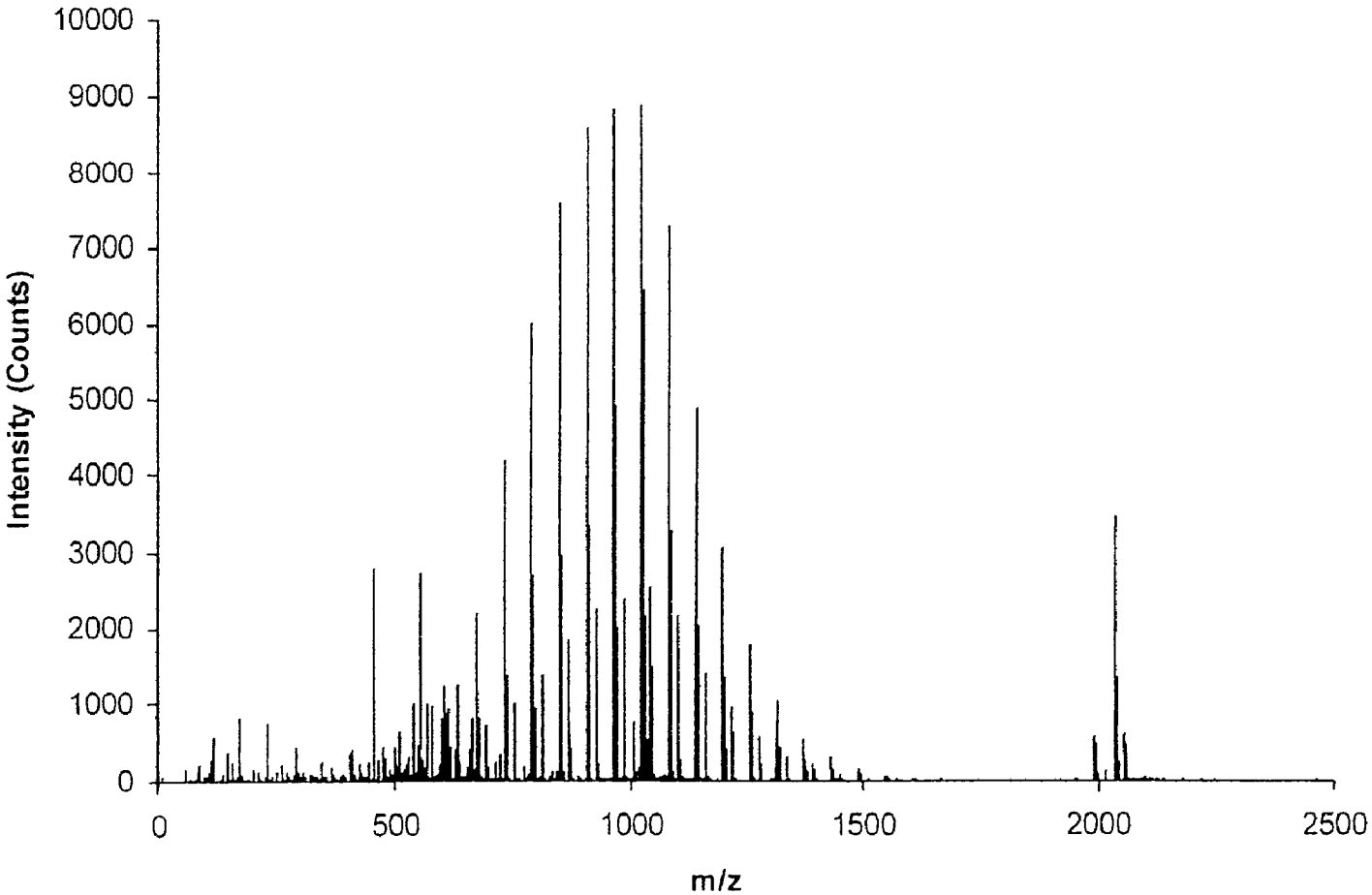
FIG. 2B PRIOR ART

FIG. 2B shows a corresponding mass spectrum which relates to the time of flight spectrum shown in FIG. 2A. A time of flight spectrum may be converted into a mass spectrum using the following relation:

$$m/z = \frac{T^2}{K^2} \tag{3}$$

wherein T is the time of flight and K is a parameter related to the instrument geometry and field strengths.

Figure 3:
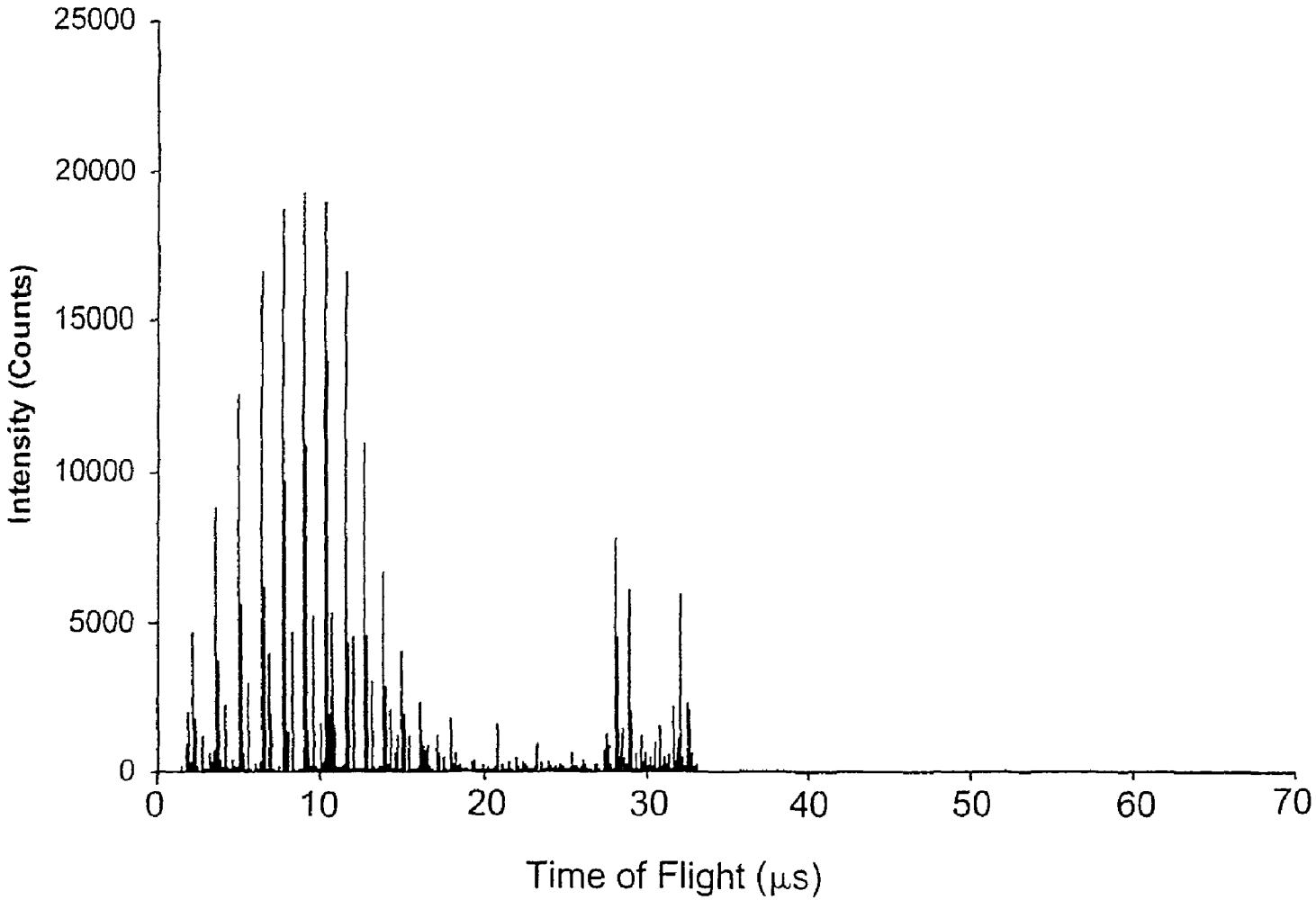
FIG. 3 shows a time of flight spectrum according to an embodiment wherein some ions have undergone wrap-around.

FIG. 3 shows a time of flight spectrum which was obtained according to an embodiment of the present invention wherein the time period between successive applications of the orthogonal acceleration field was reduced to 33 μs. The time of flight spectrum shown in FIG. 3 exhibits spectral wrap-around i.e. the time of flight spectrum includes ions from a previous packet of ions which were orthogonally accelerated but which appear in the present time of flight spectrum.

If FIGS. 2A and 3 are compared then it is apparent that peaks that had a previously recorded time of flight greater than 33 μs are now wrapped-around and appear at apparent flight times of between 0 and 33 μs. It is also evident that advantageously the transmission of the Time of Flight mass analyser has been increased by approximately a factor of x2 due to an increase in the sampling duty cycle as a result of increasing the frequency of the orthogonal acceleration pulses. Operating the Time of Flight mass analyser with a time period between successive orthogonal acceleration pulses of 33 μs rather than 66 μs means that a time of flight data set will include some ions which were orthogonally accelerated by a previous orthogonal acceleration pulse and some ions which were orthogonally accelerated by a subsequent orthogonal acceleration pulse. Each point on the time of flight axis may therefore correspond to or include two different time of flight measurements.

The first time of flight measurement is the time of flight $T_s$ of ions which have not been wrapped-around and which is related to mass to charge ratio by the following equation:

$$T_s=K\cdot(m/z)^{1/2} \quad (4)$$

The second time of flight measurement $T_R$ relates to the time of flight of ions which have been wrapped-around and is related to mass to charge ratio by the equation:

$$T_R=K\cdot(m/z)^{1/2}-\Delta t \quad (5)$$

wherein Δt is the time period between successive orthogonal acceleration periods and $T_R$ is the apparent time of flight of the ions which have been subject to wrap-around.

The actual time of flight $T_{RO}$ of these ions is given by the equation:

$$T_{RO}=T_R+\Delta t \quad (6)$$

From the above equations it is apparent that a change in Δt will result in a change in the second time of flight measurement $T_R$ but will not in a change in the first time of flight measurement $T_S$.

Figure 4:
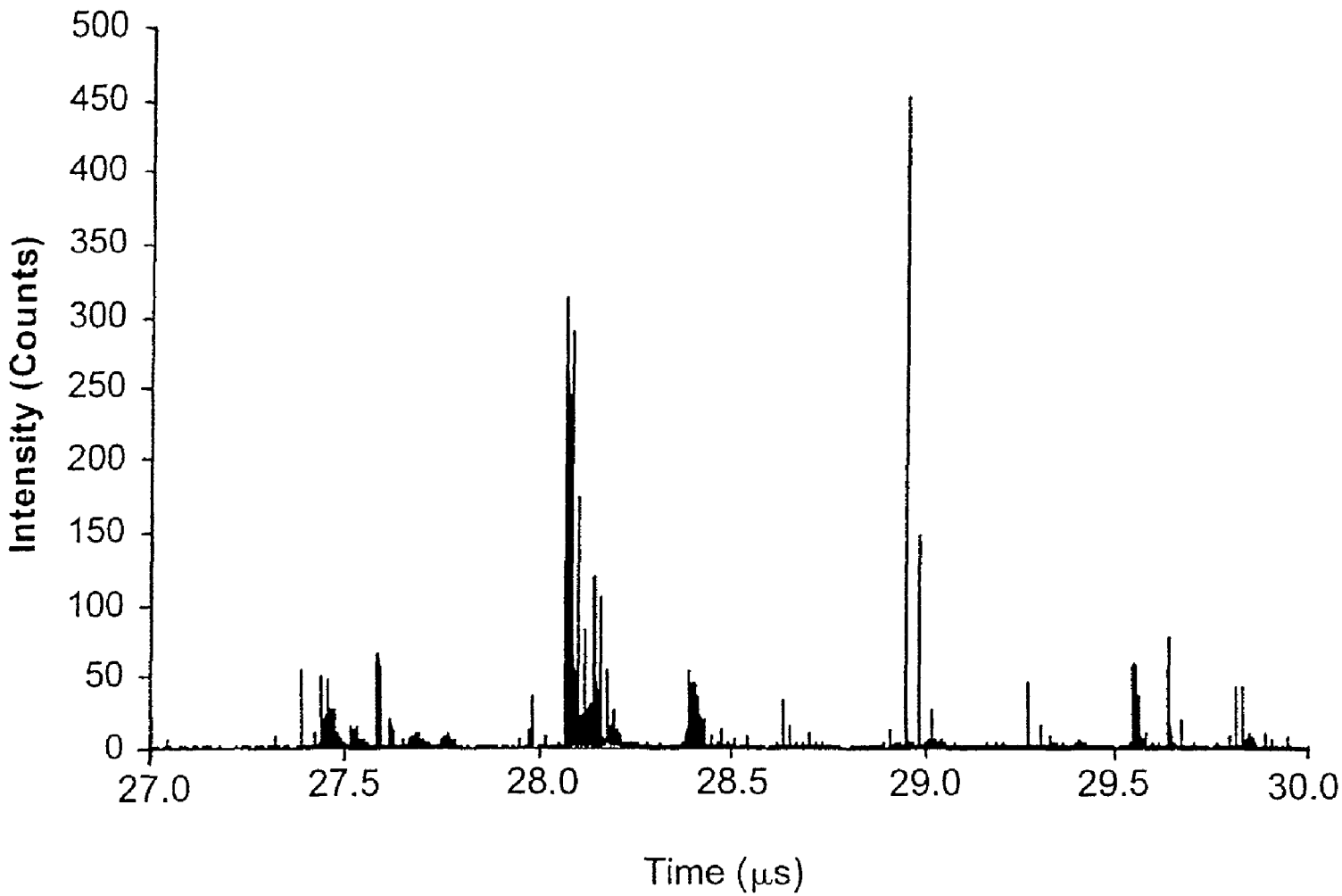
FIG. 4 shows a time of flight spectrum according to an embodiment wherein some ions have undergone wrap-around and wherein the time period between successive orthogonal acceleration pulses was set at 33 μs.

FIG. 4 shows the same time of flight data as shown in FIG. 3 but restricted to show just data relating to ions having arrival times between 27 μs and 30 μs. Since the period between successive orthogonal acceleration pulses was set at 33 μs then the data is likely to include some peaks that correspond with ions that have been subject to wrap-around.

Figure 5:
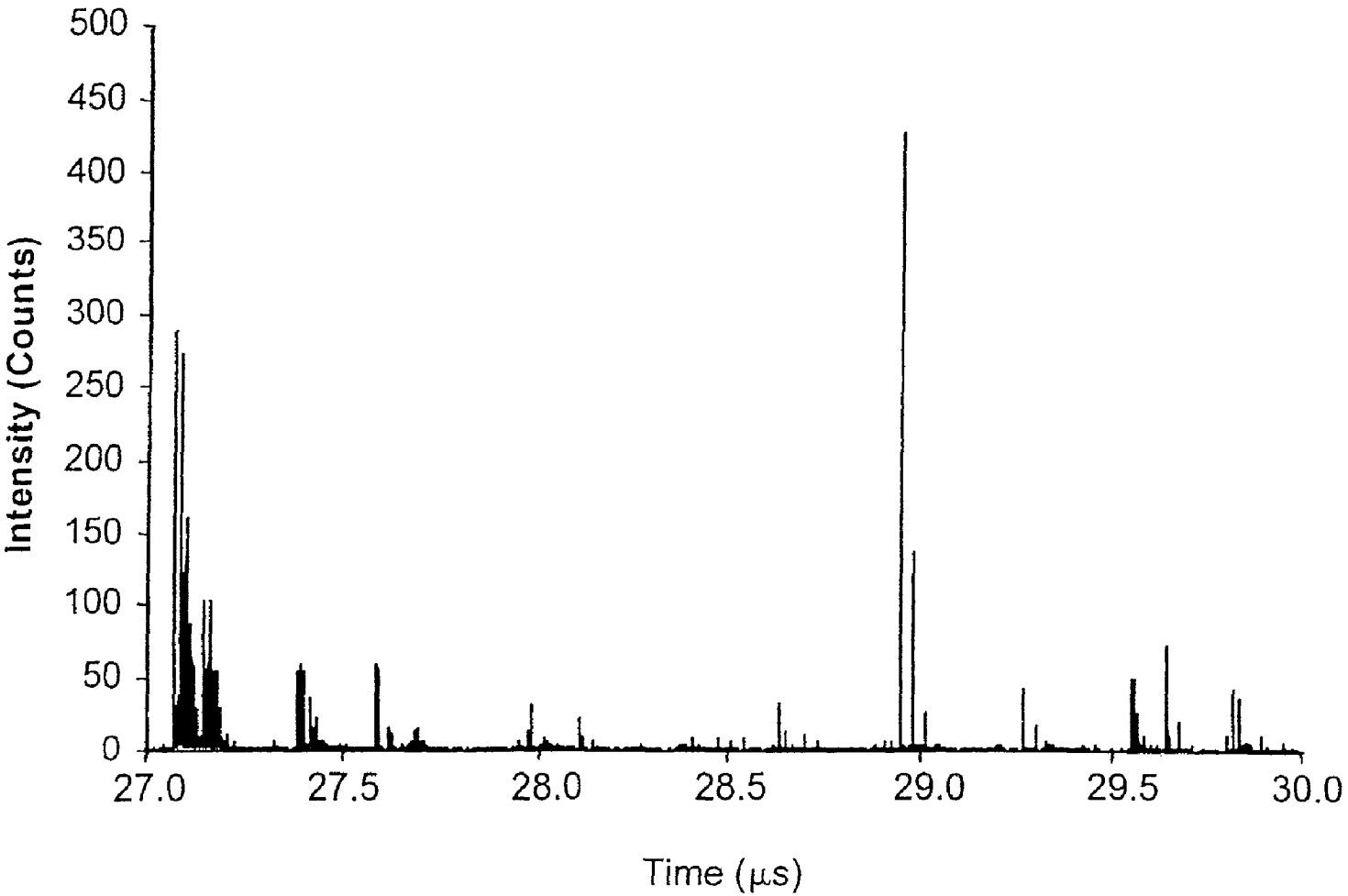
FIG. 5 shows a time of flight spectrum according to an embodiment wherein some ions have undergone wrap-around and the time period between successive orthogonal acceleration pulses was increased to 34 μs.

FIG. 5 shows a corresponding time of flight spectrum which was obtained by increasing the time period between successive orthogonal acceleration pulses from 33 μs to 34 μs. From a comparison of the time of flight spectra shown in FIGS. 4 and 5 it is apparent that the major peaks which are observed as having arrival times of approximately 29 μs in both FIGS. 4 and 5 relate to ions which are not subject to wrap-around since the peaks are observed in both mass spectra at the same arrival times. However, the major peaks which are observed as having arrival times of approximately 28.2 μs in FIG. 4 can be identified as relating to ions which are subject to wrap-around since their arrival time has reduced to approximately 27.2 μs in FIG. 5.

Figure 6:
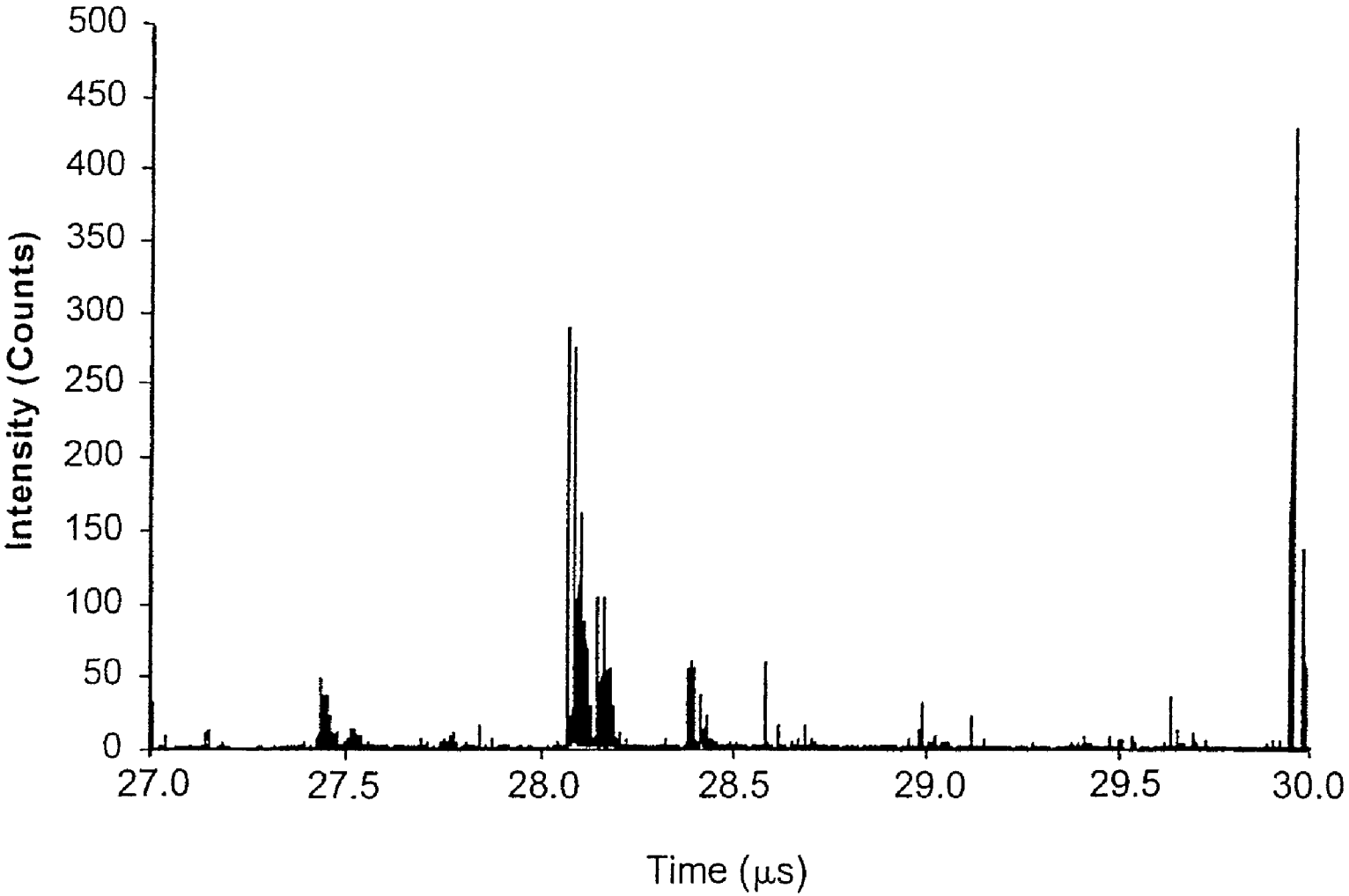
FIG. 6 shows the time of flight spectrum shown in FIG. 5 shifted by 1 μs.

FIG. 6 shows the time of flight data shown in FIG. 5 but shifted by 1 μs and confirms that the peaks having an ion arrival time of approximately 27.2 μs in FIG. 5 (or 28.2 μs as shifted in FIG. 6) relate to the same ion species as the peaks having an arrival time of approximately 28.2 μs in FIG. 4 since these specific peaks are now re-aligned.

According to the preferred embodiment the presence of wrapped-around peaks can be recognised in different ways. According to an embodiment, data may initially be acquired over a first acquisition period and with a first time period Δt1 being maintained between successive orthogonal acceleration pulses. Data may then be acquired over a second subsequent acquisition period and with a second different time period Δt2 being maintained between successive orthogonal acceleration pulses. The lengths of the first and second acquisition periods are preferably substantially the same.

According to an embodiment the first data set acquired with a first time period Δt1 between successive orthogonal acceleration pulses may firstly be summed with the second data set acquired with a second different time period Δt2 between successive orthogonal acceleration pulses. A new combined data set D1 of arrival times and intensities is thereby generated. This first step is equivalent, in effect, to summing the time of flight spectra shown in FIGS. 4 and 5.

Secondly, the first data set acquired with a first time period Δt1 between successive orthogonal acceleration pulses may then be summed with a modified second data set. The modified second data set corresponds to the second data set as was acquired with a second time period Δt2 between successive orthogonal acceleration pulses but wherein the time axis has been shifted by a time period which equals the difference between the first and second time periods (i.e. Δt2−Δt1). A new second combined data set D2 of arrival times and intensities can thereby be generated. This second step is equivalent, in effect, to summing the time of flight spectra shown in FIGS. 4 and 6.

According to an embodiment the first and second combined data sets D1,D2 may then be compared and peaks which relate to ions which have undergone wrap-around are preferably identified. According to an embodiment each arrival time interval is preferably tested to see whether there are peaks having intensities which are approximately twice the intensity in the first combined data set D1 than in the second combined data set D2. Peaks which have approximately twice the intensity in the first combined data set D1 than in the second combined data set D2 are preferably considered as relating to ion counts corresponding to mass spectral peaks that have not undergone wrap-around. For example, if the first combined data set D1 relates to a combination of the data shown in FIGS. 4 and 5 then a peak will be observed at a flight time of approximately 29 μs which will have approximately twice the intensity of a corresponding peak having a flight time of approximately 29 μs in a second combined data set D2 which relates to a combination of the data shown in FIGS. 4 and 6.

Alternatively and/or in addition, each arrival time interval may be tested for intensities that are approximately twice the intensity in, the second combined data set D2 than in the first combined data set D1. Peaks which have approximately twice the intensity in the second combined data set D2 than in the first combined data set D1 may be considered as relating to ion counts which correspond with ions or mass spectral peaks that have undergone wrap-around.

A smoothing algorithm may be applied to the first combined data set D1 and/or the second combined data set D2 before comparison tests are applied to determine which data relates to ions or mass spectral peaks which have been wrapped-around and which does not.

Following recognition of data that comprises wrapped-around and/or non wrapped-around data, the data may then be divided into two sets. The first set may comprise wrapped-around data and the second set may comprise non wrapped-around data. The first time of flight data set may then be transformed to a mass spectrum in the normal way. The second time of flight data set relating to wrapped-around data may be adjusted to correct the arrival times. The data is then preferably transformed into a mass spectrum or mass spectral data. For the purpose of presentation of a full mass spectrum the time-corrected wrapped-around data may be combined with the non wrapped-around data from the previous orthogonal acceleration pulse. The resulting combined data set preferably comprises or relates to the full data set for the packet of ions accelerated into the Time of Flight mass spectrometer from the previous pulse.

For the data illustrated in FIGS. 4, 5 and 6 wrapped-around data may be time corrected by adding 33 μs to the observed ion arrival time. For example, the mass spectral peak observed as having an arrival time of approximately 28.2 μs may be corrected to have a time of flight equal of 61.2 μs. This corresponds to the peak observed at 61.2 μs in FIG. 2A. Once the correct time of flight has been assigned, the time of flight spectrum may then be converted to a mass spectrum as previously described.

According to another embodiment, the first combined data set D1 and the second combined data set D2 may first be subjected to peak detection and the peaks centroided so that a first peak list P1 comprising arrival time and intensity pairs corresponding to the first combined data set and a second peak list P2 comprising arrival time and intensity pairs corresponding to the second combined data set are produced. A comparison of the first and second peak lists P1,P2 may be performed to reveal peaks that have undergone wrap-around. For example, a peak in peak list P1 may be tested or examined to see whether the peak has substantially twice the intensity as that of a corresponding peak in peak list P2 which has substantially the same peak centroid time. Where this occurs, it may then be assumed that the peak has not undergone wrap-around and that its time of flight does not need to be corrected. Alternatively or in addition, peaks present in peak list P2 may be tested or examined to see whether the peak has substantially twice the intensity as that of a corresponding peak in peak list P1 which has substantially the same peak centroid time. Where this occurs, it may then be assumed that the peak has undergone wrap-around and that its time of flight needs to be corrected by adding the time difference between the two different pulse rates.

Once a wrapped-around peak has been identified it may then be assigned a correct time of flight equal to the measured or apparent time of flight plus the time period Δt between successive orthogonal acceleration pulses. In the case of the data shown in FIG. 4 this would be equivalent to adding 33 μs to the recorded ion arrival time. For example, the peak observed as having an arrival time of approximately 28.2 μs would have a corrected time of flight equal to approximately 61.2 μs. Once the correct time of flight has been assigned, the time of flight data may be converted to mass to charge ratio data or a mass spectrum as previously described.

Further embodiments are contemplated wherein the pulse period may be reduced still further to one third, one quarter or one fifth of the flight time of ions having the maximum mass to charge ratio which were orthogonally accelerated into the drift or time of flight region of the Time of Flight mass analyser. This will lead to a greater increase in duty cycle.

Although the present invention has been described with reference to preferred embodiments, it will be understood by those skilled in the art that various changes in form and detail may be made without departing from the scope of the present invention as set forth in the accompanying claims.

The invention claimed is:

1. A method of mass spectrometry comprising:

providing a Time of Flight mass analyser comprising an orthogonal acceleration electrode and a drift or time of flight region;

repeatedly energising said orthogonal acceleration electrode so as to repeatedly orthogonally accelerate packets of ions into said drift or time of flight region, wherein the periodicity of energising said orthogonal acceleration electrode or the time period between successive energisations of said orthogonal acceleration electrode is less than the time of flight of ions having the maximum mass to charge ratio within said packets of ions which are orthogonally accelerated into said drift or time of flight region;

orthogonally accelerating packets of ions into said drift or time of flight region with a first periodicity or wherein a first time period Δt1 is maintained between successive energisations of said orthogonal acceleration electrode; and obtaining first time of flight or mass spectral data;

orthogonally accelerating packets of ions into said drift or time of flight region with a second periodicity or wherein a second different time period Δt2 is maintained between successive energisations of said orthogonal acceleration electrode; and obtaining second time of flight or mass spectral data;

comparing said first time of flight or mass spectral data with said second time of flight or mass spectral data; and identifying as non-wrapped data, time of flight or mass spectral peaks which have substantially the same time of flight, mass or mass to charge ratio and/or substantially the same intensity in said first time of flight or mass spectral data as in said second time of flight or mass spectral data.

2. A method as claimed in claim 1, further comprising combining said first time of flight or mass spectral data and said second time of flight or mass spectral data to produce a first combined data set D1.

3. A method as claimed in claim 2, further comprising obtaining modified second time of flight or mass spectral data by shifting, translating, adjusting or correcting said second time of flight or mass spectral data by a time period or a mass to charge ratio value which is substantially equal to or which corresponds to the difference between said first time period Δt1 and said second time period Δt2.

4. A method as claimed in claim 3, further comprising combining said first time of flight or mass spectral data and said second modified time of flight or mass spectral data to produce a second combined data set D2, and comparing said first combined data set D1 and said second combined data set D2.

5. A method as claimed in claim 1, further comprising determining whether or not one or more peaks in said first time of flight or mass spectral data correspond with one or more peaks in said second time of flight or mass spectral data having substantially the same time of flight, mass or mass to charge ratio and/or substantially the same intensity.

6. A method as claimed in claim 4, wherein said step of comparing said first combined data set D1 and said second combined data set D2 comprises:

determining the ratio of the intensity I1 of a time of flight peak or mass spectral peak at a first time or mass to charge ratio in said first combined data set D1 to the intensity I2 of a time of flight peak or mass spectral peak at substantially the same first time or mass to charge ratio in said second combined data set D2; and determining whether or not said ratio equals or exceeds a value y1.

7. A method as claimed in claim 4, further comprising converting said first combined data set D1 into a first peak list P1 of the time of flight or mass to charge ratio and associated intensity of each peak in said first combined data set D1;

converting said second combined data set D2 into a second peak list P2 of the time of flight or mass to charge ratio and associated intensity of each peak in said second combined data set D2;

comparing said first peak list P1 with said second peak list P2; and determining whether or not one or more peaks in said first peak list P1 correspond with one or more peaks in said second peak list P2 having substantially the same time of flight, mass or mass to charge ratio and/or substantially the same intensity.

8. A method as claimed in claim 7, further comprising identifying as non-wrapped data, time of flight or mass spectral peaks which have substantially the same time of flight, mass or mass to charge ratio and/or substantially the same intensity in said first peak list P1 as in said second peak list P2.

9. A method as claimed in claim 7, further comprising determining the ratio of the intensity of a peak in said first peak list P1 having a first time of flight or mass to charge ratio to the intensity of a peak in said second peak list P2 having substantially the same first time of flight or mass to charge ratio; and determining whether said ratio equals or exceeds a value y2.

10. A method as claimed in claim 1, further comprising:

orthogonally accelerating one or more first packets of ions into said drift or time of flight region and operating said Time of Flight mass analyser in a first mode of operation wherein ions having a first mass to charge ratio are arranged to have a first time of flight from being orthogonally accelerated to impinging upon or reaching an ion detector or other device; and orthogonally accelerating one or more second packets of ions into said drift or time of flight region and operating said Time of Flight mass analyser in a second mode of operation wherein ions having said first mass to charge ratio are arranged to have a second different time of flight from being orthogonally accelerated to impinging upon or reaching an ion detector or other device.

11. A method as claimed in claim 1, further comprising determining whether or not peaks in said first time of flight or mass spectral data and/or said second time of flight or mass spectral data have a peak width less than or greater than a predetermined or relative amount.

12. A method as claimed in claim 1, further comprising:

mass filtering ions so that ions having mass to charge ratios within a first range are substantially attenuated or are not onwardly transmitted; and determining whether or not peaks in said first time of flight or mass spectral data and/or said second time of flight or mass spectral data have a time of flight, mass or mass to charge ratio which would be expected of ions having mass to charge ratios falling within said first range.

13. A method as claimed in claim 3, further comprising correcting time of flight or mass spectral peak data which relates to or which includes wrapped-around data.

14. A Time of Flight mass analyser comprising an orthogonal acceleration electrode and a drift or time of flight region; and control means arranged and adapted to repeatedly energise said orthogonal acceleration electrode so as to repeatedly orthogonally accelerate packets of ions into said drift or time of flight region, wherein the periodicity of energising said orthogonal acceleration electrode or the time period between successive energisations of said orthogonal acceleration electrode is less than the time of flight of ions having the maximum mass to charge ratio within said packets which are orthogonally accelerated into said drift or time of flight region;

wherein said mass analyser:

orthogonally accelerates packets of ions into said drift or time of flight region with a first periodicity or wherein a first time period $\Delta t1$ is maintained between successive energisations of said orthogonal acceleration electrode; and obtains first time of flight or mass spectral data;

orthogonally accelerates packets of ions into said drift or time of flight region with a second periodicity or wherein a second different time period $\Delta t2$ is maintained between successive energisations of said orthogonal acceleration electrode; and obtains second time of flight or mass spectral data;

compares said first time of flight or mass spectral data with said second time of flight or mass spectral data; and identifies as non-wrapped data, time of flight or mass spectral peaks which have substantially the same time of flight, mass or mass to charge ratio and/or substantially the same intensity in said first time of flight or mass spectral data as in said second time of flight or mass spectral data.

15. A mass spectrometer comprising a Time of Flight mass analyser claimed in claim 14.

* * * * *